US007369033B2

(12) United States Patent
Matsukawa et al.

(10) Patent No.: US 7,369,033 B2
(45) Date of Patent: May 6, 2008

(54) ROTATING TYPE VARIABLE RESISTOR

(75) Inventors: Kenetsu Matsukawa, Miyagi-ken (JP); Hirofumi Kawano, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 170 days.

(21) Appl. No.: 11/058,771

(22) Filed: Feb. 15, 2005

(65) Prior Publication Data

US 2005/0184850 A1 Aug. 25, 2005

(30) Foreign Application Priority Data

Feb. 24, 2004 (JP) ..... 2004-047892

(51) Int. Cl.
*H01C 10/32* (2006.01)

(52) U.S. Cl. ..... 338/162; 338/122; 338/138

(58) Field of Classification Search ..... 338/9, 338/122, 123, 127, 128, 131, 132, 162, 164, 338/167, 170, 174, 181, 308, 319, 322; 204/403.06
See application file for complete search history.

(56) References Cited

U.S. PATENT DOCUMENTS 2,751,473 A * 6/1956 Coler et al. ..... 338/9
2,873,336 A * 2/1959 Tassara ..... 338/127
3,579,169 A * 5/1971 Dickinson ..... 338/170
3,602,861 A * 8/1971 Tweed et al. ..... 338/162
4,075,597 A * 2/1978 Peart ..... 338/128
4,223,294 A * 9/1980 Moffitt et al. ..... 338/122
6,275,140 B1 8/2001 Asano
6,471,839 B1 * 10/2002 Yamamoto et al. .... 204/403.06

FOREIGN PATENT DOCUMENTS

JP 11-176287 7/1999

* cited by examiner

*Primary Examiner*—Elvin Enad
*Assistant Examiner*—Joselito Baisa
(74) *Attorney, Agent, or Firm*—Beyer Law Group LLP

(57) ABSTRACT

The rotating type variable resistor includes a housing; a rotating member disposed to be rotatable in the housing; a ring-shaped support member having a conductive pattern at one surface of the support member and disposed at any one side between the housing and the rotating member; and a sliding member disposed at the other side between the housing and the rotating member, and capable of sliding relative to the conductive pattern, wherein the conductive pattern is composed of a high resistor unit containing carbon and a low resistor unit having a specific resistance lower than that of the high resistor unit, and the high resistor unit and the low resistor unit are alternately and repeatedly formed along a direction where the conductive pattern and the sliding member slide.

6 Claims, 4 Drawing Sheets

ROTATING TYPE VARIABLE RESISTOR

BACKGROUND OF THE INVENTION

1. Field of the Invention

The present invention relates to a rotating type variable resistor, and in particular, to a structure of a rotating type variable resistor employed for various controllers such as an electronic apparatus especially for the use in a vehicle.

2. Description of the Related Art

A structure of a rotating electric component such as a rotating type variable resistor and an encoder in the related art has a case having a hollow support member and a plurality of contact members (i.e. sliding contacts) embedded in a support unit, an axial member (i.e. rotating member) having a hollow axial unit and being rotatably supported by a case and having a conductive pattern formed in a rotating unit, and a mounting member (i.e. cover member) covering the top of the case (for example, see patent document 1).

Hereinafter, the structure of the rotating electric component of the related art will be described with reference to the accompanying drawings.

FIG. 6 is a cross-sectional view illustrating a rotating electric component of the related art, and FIG. 7 is a disassembled perspective view illustrating the rotating electric component.

Referring to FIGS. 6 and 7, the case 21 molded with a synthetic resin has a rectangular support unit 21*b* having a ring-shaped concave unit 21*a*, and a cylindrical support unit 21*d* having a penetrating hole 21*c* at its center and being perpendicular to the center of the support unit 21*b*, and a plurality of contact members 22 are embedded as a unit with the terminal in the support unit 21*b* of the case 21.

The axial member 23 molded with a synthetic resin has an axial unit 23*b* having a penetrating hole 23*a* at its center, and a ring-shaped rotating member 23*c* formed at the lower end of the axial unit 23*b*, and the axial unit 23*b* and the rotating member 23*c* are shaped as a unit, and the axial unit 23*b* is shaped like a cylinder having the same diameter throughout the length and thus a straight contour. And a conductive pattern 24 composed of a resistor or a code pattern is formed at the lower surface of the rotating member 23*c*, and an axial member 23 having the conductive pattern 24 inserts the support unit 21*d* to the penetrating hole 23*a*, and the rotating unit 23*c* is received within the concave unit 21*a* so that it is rotatably fitted in to the case 21.

A mounting plate 25 molded with a metal plate has a flat portion 25*b* having a hole 25*a*, a pair of legs 25*c* rectangularly bent from the flat portion 25*b*, and a plurality of mounting portions 25*d* rectangularly bent from the flat portion 25*b*, and the axial unit 23*b* and the support unit 21*d* are inserted to the hole 25*a* of the mounting plate 25 to allow the flat portion 25*b* to cover one surface of the rotating unit 23*c*, and a front end of the leg 25*c* is bent to the lower surface of the case 21 to allow the case 21 and the axial member 23 to fit together, and thus the mounting plate 25 has the functions of a mounting body and a case.

When a rotating electric component having the above-described configuration rotates the axial portion 23*b* of the axial member 23, the rotating unit 23*c* and the conductive pattern 24 rotate, and the contact piece 22 slides on and contacts with the conductive pattern 24, therefore an output signal is produced.

Further, the rotating electric component of such a configuration is mounted in a printed circuit board (not shown), and a push button switch 26 is disposed in the printed circuit board positioned within the penetrating hole 21*c* of the case 21 as shown in FIG. 6. And the support unit 21*d* of the case 21 and the axial portion 23*b* of the axial member 23 are cylindrical-shaped, so that another electric component can be disposed in the center space thereof, which yields an electric component having a good space factor.

SUMMARY OF THE INVENTION

However, in the above-described rotating electric component, a rotating unit disposed at the lower end of the axial member and having a conductive pattern is ring-shaped, and is also hollow-shaped to have a large penetrating hole in its center, so that the pattern of the resistor can not be thick, and it becomes elongated, which causes a difficulty in decreasing a total resistance by, for example, about 10 kΩ in order to read a voltage output with an analog to digital (A/D) converter of a central processing unit (CPU). In addition, when a low resistor ink is employed in order to decrease the total resistance, an amount of carbon contained in the ink is increased, which cause the resistor to be weak, so that the sliding lifetime deteriorates from damping etc.

To solve these problems in the conventional method, it is an object of the present invention to provide a rotating type variable resistor capable of reducing a total resistance even when a ring-shaped support member where a conductive pattern such as a resistor is disposed has a hollow shape.

The above object of the present invention is achieved by a first aspect of a rotating type variable resistor, which includes: a housing; a rotating member rotatably disposed in the housing; a ring-shaped support member having a conductive pattern at one surface of the support member and disposed at one of the housing and the rotating member; and a sliding member disposed at the rest of the housing and the rotating member, and capable of sliding relative to the conductive pattern, wherein the conductive pattern is composed of a high resistor unit containing carbon and a low resistor unit having a specific resistance lower than that of the high resistor unit, and the high resistor unit and the low resistor unit are alternately and repeatedly formed along a direction where the conductive pattern and the sliding member slide.

In a second aspect, the high resistor unit is formed of a binder resin in which carbon black and graphite are dispersed. And in a third aspect, the low resistor unit is composed of a silver layer and a carbon layer covering the silver layer, and the carbon layer and the high resistor unit are formed of the same material.

In a fourth aspect, the conductive pattern is arc-shaped such that a summed region of the low resistor units is larger than that of the high resistor units. And in a fifth aspect, the rotating type variable resistor further includes a click body supporting the rotating member at a predetermined position, wherein the rotating member is supported by the click body when the sliding member is in contact with the low resistor unit of the conductive pattern so that a positional relationship between the conductive pattern and the sliding member is kept in a stable state.

According to the present invention as mentioned above, the rotating type variable resistor includes a housing; a rotating member disposed to be rotatable in the housing; a ring-shaped support member having a conductive pattern at one surface of the support member and disposed at one of the housing and the rotating member; and a sliding member disposed at the rest of the housing and the rotating member, and capable of sliding relative to the conductive pattern, wherein the conductive pattern is composed of a high resistor unit containing carbon and a low resistor unit having a specific resistance lower than that of the high resistor unit, and the high resistor unit and the low resistor unit are alternately and repeatedly formed along a direction where the conductive pattern and the sliding member slide, so that a total resistance value of the conductive pattern may be decreased.

In addition, the high resistor unit is formed of a binder resin in which carbon black and graphite are dispersed, so that the total resistance can be further suppressed because of the contained graphite. In addition, the low resistor unit is composed of a silver layer and a carbon layer covering the silver layer, and the carbon layer and the high resistor unit are formed of the same material, so that the formation of the high resistor unit and the carbon layer covering the silver layer can be performed with the same process, which allows the productivity to be enhanced.

In addition, the conductive pattern is arc-shaped such that the entire region of the low resistor units is larger than that of the high resistor units, so that the total resistance of the conductive pattern can be further suppressed from being increased because of the larger summed region of the low resistor unit.

In addition, the rotating type variable resistor further includes a click body supporting the rotating member at a predetermined position, wherein the rotating member is supported by the click body when the sliding member is in contact with the low resistor unit of the conductive pattern so that a positional relationship between the conductive pattern and the sliding member is kept in a stable state by the click body, which does not yield a significant output change in the clicked position so that a stable output is obtained.

DESCRIPTION OF THE PREFERRED EMBODIMENTS

Hereinafter, preferred embodiments of the present invention regarding the rotating type variable resistor will be described with reference to FIGS. 1 to 5.

Figure 1:
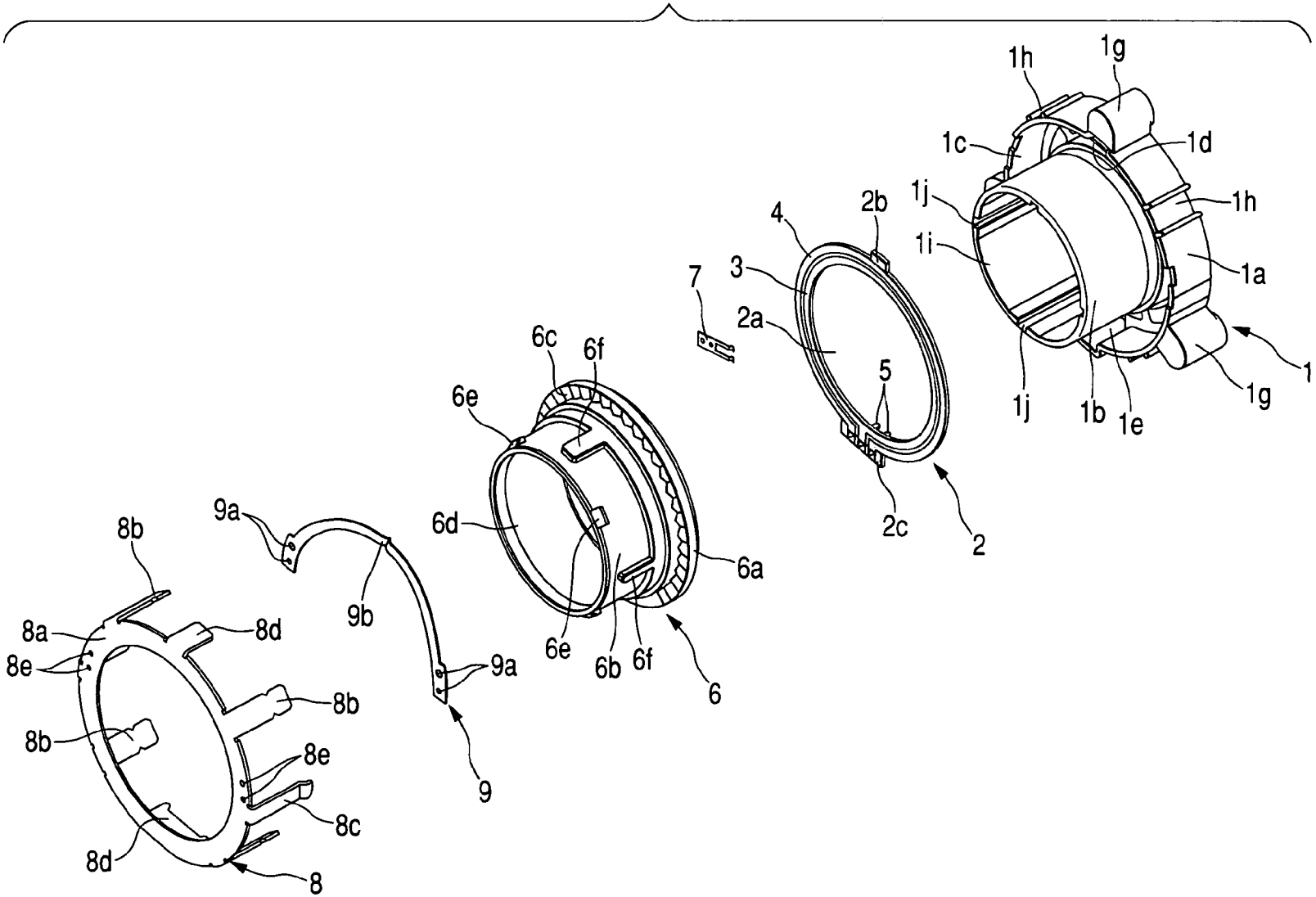
FIG. 1 is a disassembled perspective view illustrating a rotating type variable resistor of the present invention.
Figure 2:
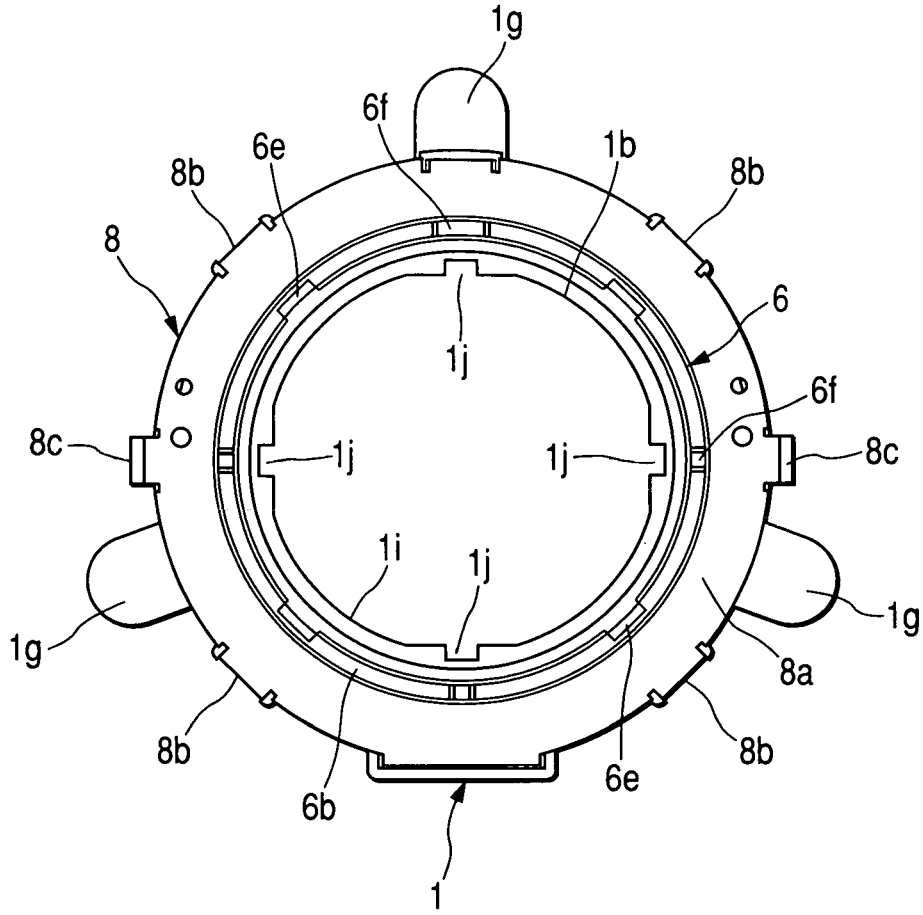
FIG. 2 is a plan view illustrating a rotating type variable resistor of the present invention.
Figure 3:
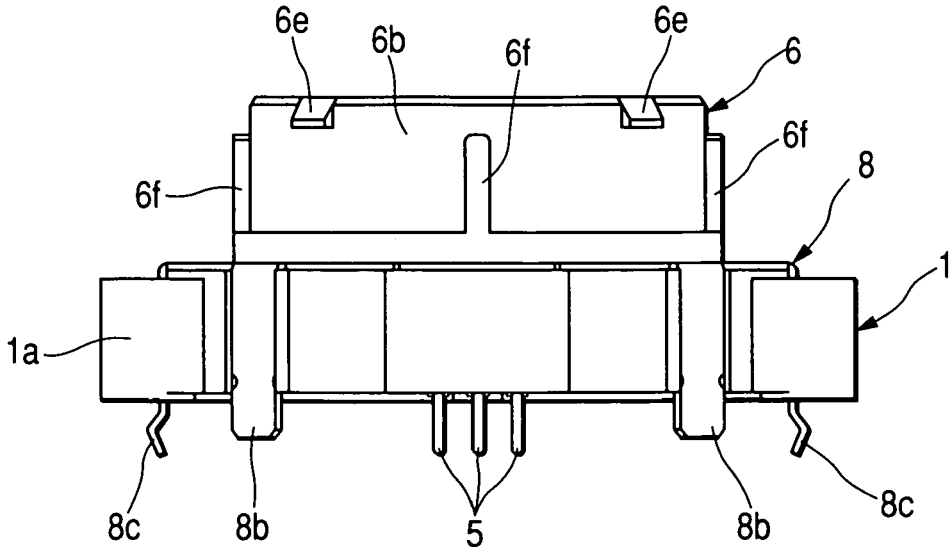
FIG. 3 is a front view illustrating a rotating type variable resistor of the present invention.
Figure 4:
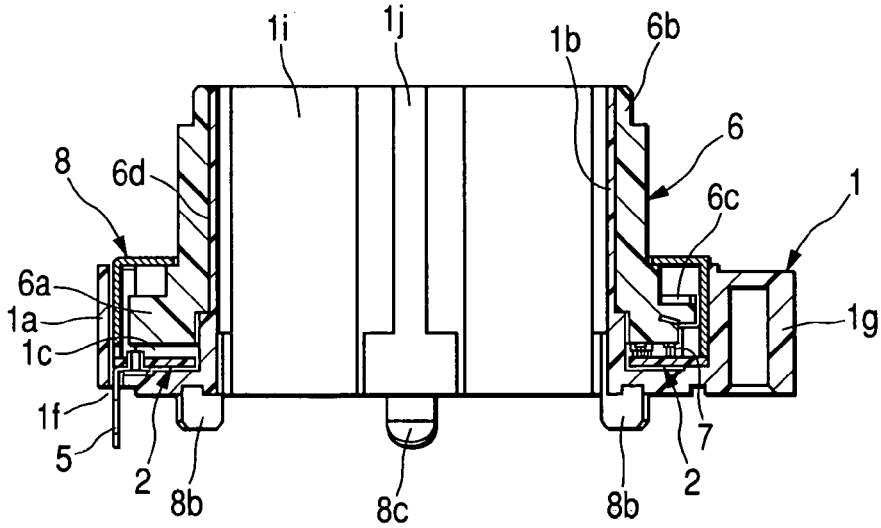
FIG. 4 is a lateral cross-sectional view illustrating a rotating type variable resistor of the present invention.
Figure 5:
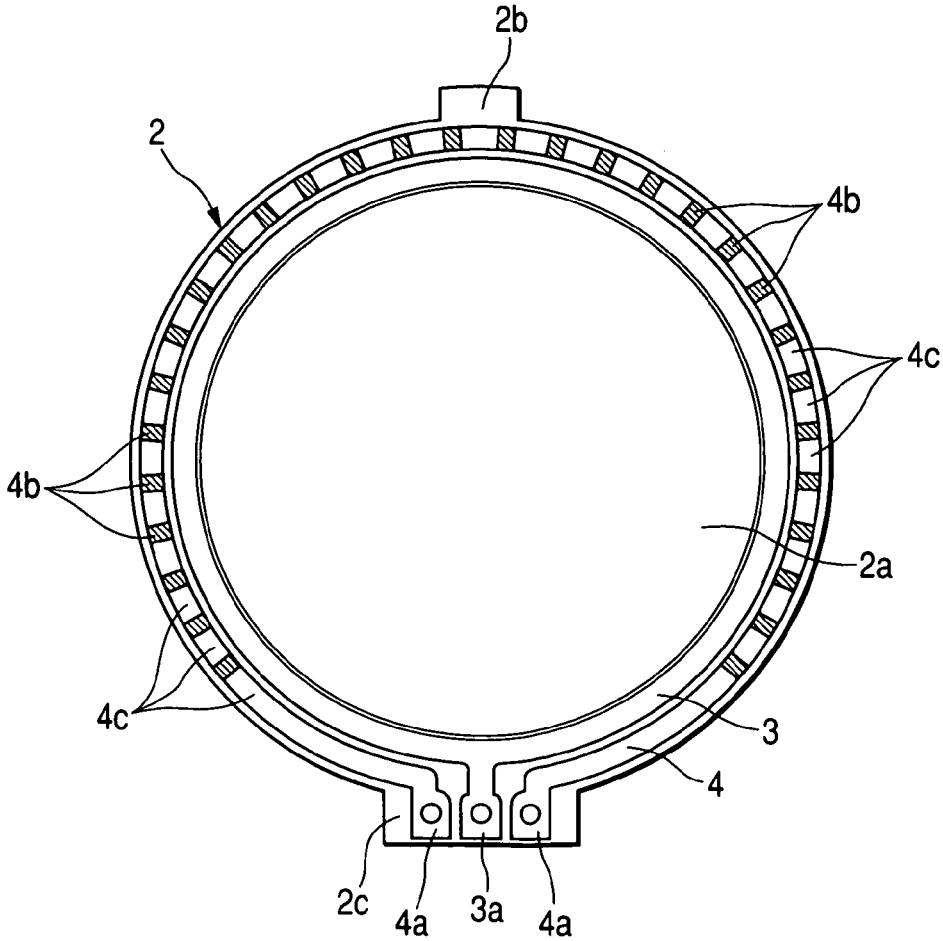
FIG. 5 is a plan view illustrating a conductive pattern and a support unit of the present invention.
Figure 6:
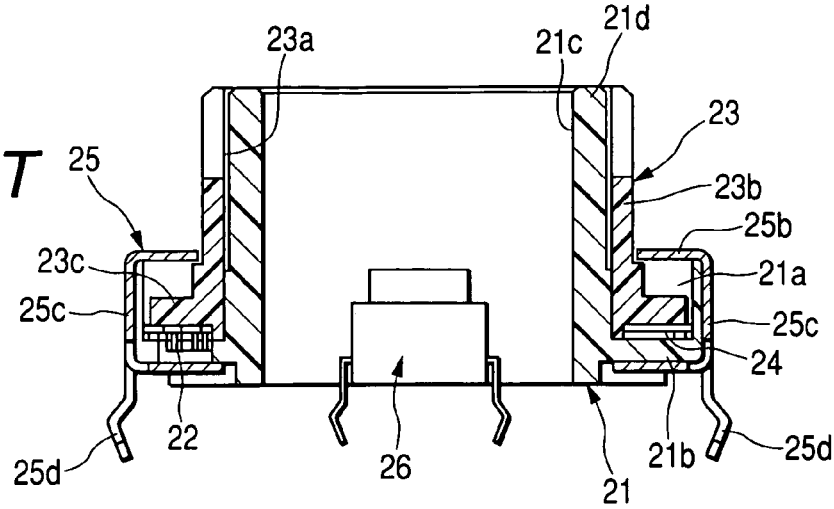
FIG. 6 PRIOR ART
FIG. 6 is a cross-sectional view illustrating a rotating type variable resistor of the related art.
Figure 7:
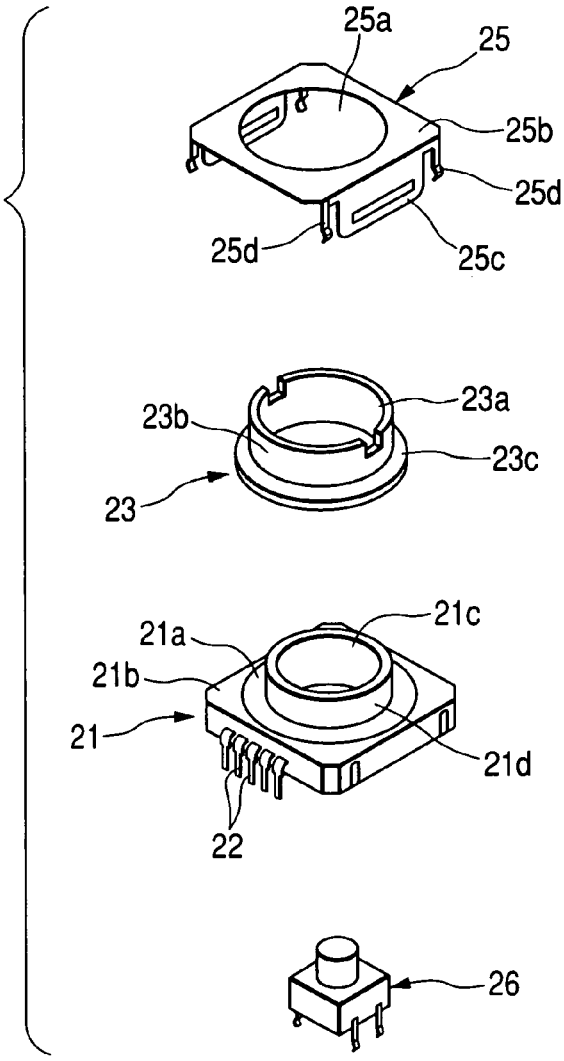
FIG. 7 PRIOR ART
FIG. 7 is a disassembled perspective view illustrating a rotating type variable resistor of the related art.

FIG. 1 is a disassembled perspective view illustrating a rotating type variable resistor of the present invention, FIG. 2 is a plan view illustrating a rotating type variable resistor of the present invention, FIG. 3 is a front view illustrating a rotating type variable resistor of the present invention, FIG. 4 is a lateral cross-sectional view illustrating a rotating type variable resistor of the present invention, and FIG. 5 is a plan view illustrating a conductive pattern and a support unit of the present invention.

Referring to FIGS. 1 to 4, the housing 1 is formed of an insulating material such as a synthetic resin, and has a substantially circular support unit 1*a* and a cylindrical axis 1*b* protruded at the center of the support unit 1*a*. The support unit 1*a* is shaped like a box having an opening at its front surface (the top surface in FIG. 4), and a concave-shaped receiving unit 1*c* in its inside. In addition, at the top and bottom positions of an inner wall facing to the cylindrical axis 1*b* in the receiving unit 1*c* of FIG. 1, a pair of concave engagements 1*d* and 1*e* which engage protrusion units 2*b* and 2*c* of the support member 2 described later is provided, and at one end of the inner bottom surface of the engagement concave unit 1*e*, a terminal hole 1*f* which allows the connection terminal 5 of the support member 2 to protrude toward the bottom surface of the housing 1 is provided.

In addition, at the external portion of the support unit 1*a*, a plurality of outward protruding legs 1*g*, and a plurality of concave grooves 1*h* are provided, and a locking piece 8*b* of a cover member 8 described later is engaged with the concave groove 1*h* so that the cover member 8 is mounted in the housing 1. In addition, the cylindrical axis 1*b* is hollow, and has a large penetrating hole 1*i* in its center. At the inner wall of the penetrating hole 1*i*, a plurality of guide grooves 1*j* are provided in up and down directions of FIG. 4, and a manipulating knob of an electronic apparatus (not shown) is mounted to be capable of moving up and down in the guide groove 1*j*, which is also manipulated by a push button switch within the hollow center mounted on a printed circuit board which is not shown.

As such, a large penetrating hole 1*i* is provided at the center of the housing 1, and the cylindrical axis 1*b* is hollow so that another electric component can be disposed in the center space, which allows a rotating type variable resistor having a good space factor to be obtained when it is used in a printed circuit board or the like.

The support member 2 is composed of a resin-stacked plate such as a phenol resin, and is ring-shaped which has a large opening 2*a* in its center. In addition, at the top and bottom positions of the support member 2 of FIG. 2, a pair of protrusion units 2*b* and 2*c* protruding outward are provided, and the protrusion units 2*b* and 2*c* are engaged with the pair of concave engagement units 1*d* and 1*e* provided within the receiving unit 1*c* of the housing 1 so that the support member 2 is positioned within the receiving unit 1*c*.

In addition, at one surface (e.g. the top surface) of the support member 2, a common pattern 3 as a ring-shaped current collecting body formed of a conductive material such as silver, and an arc-shaped conductive pattern 4 as a resistor formed of a conductive material such as carbon along the circumference of the common pattern 3 are provided. In addition, at the center of the protrusion unit 2*c*, an electrode 3*a* protruding from the common pattern 3 is provided, and a pair of electrodes 4*a* and 4*a* protruding from both ends of the conductive pattern 4 are provided at both sides of the electrode 3*a* interposed between the electrodes.

In addition, connection terminals 5 are fixed to the electrodes 3*a*, 4*a*, and 4*a*, and these connection terminals 5 protrude outward from the terminal hole 1*f* provided at one end of the inner bottom surface of the receiving unit 1*c*. And these connection terminals 5 are connected to the interconnection pattern on the printed circuit board of an electronic apparatus which is not shown.

In addition, the common pattern 3 is continuously formed to be ring-shaped with a conductive material such as a silver layer. In addition, the conductive pattern 4 is formed such that a high resistor unit 4*b* (hatched portion) and a low resistor unit 4*c* having a specific resistance lower than that of the high resistor unit 4*b* are alternately and repeatedly formed as shown in FIG. 5. The high resistor unit 4*b* is formed of a binder resin in which carbon black, and graphite having an effect of decreasing the resistance is dispersed. By means of the contained graphite, the total resistance can be further suppressed.

In addition, the low resistor unit is composed of a silver layer and a carbon layer covering the silver layer. And in the present embodiment, the carbon layer is formed of the same material as that forming the high resistor unit 4*b*, so that the formation of the high resistor unit 4*b* and the carbon layer covering the silver layer of the low resistor unit 4*c* can be performed with the same process, which allows the productivity to be enhanced. In addition, the common pattern 3 is composed of two-layered structure having a silver layer and a carbon layer covering the silver layer, which has the same material and configuration as the low resistor unit 4*c*.

In addition, the conductive pattern 4 is arch-shaped, and a sliding member 7 fixed to the rotating member 6 described later slides on the conductive pattern 4, wherein the conductive pattern 4 is formed such that a summed region (summed angle) of the low resistor units 4*c* is larger than that (summed angle) of the high resistor units 4*b*. In this case, both ends connected to the electrodes 4*a* and 4*a* also constitute a portion of the conductive pattern 4 and are included in the region of the low resistor unit 4*c*. In addition, in the present embodiment, each length in the circumferential direction of the low resistor unit 4*c* is longer than that in the circumferential direction of the high resistor unit 4*b*, and a sliding region where the sliding member 7 and the conductive pattern 4 slide is larger in the entire sliding region of the low resistor units 4*c* than in the entire sliding region of the high resistor units 4*b*.

As such, the summed region of the low resistor units 4*c* is larger than that of the high resistor units 4*b*, so that the total resistance of the conductive pattern 4 can be further suppressed.

The rotating member 6 is formed of an insulating material such as a synthetic resin, and has a ring-shaped rotating plate 6*a* and a rotating axis 6*b* cylindrically protruding at the center of the rotating plate 6*a*. At the bottom surface of the rotating plate 6*a*, a sliding member 7 composed of a conductive metal plate is provided, which is in elastically contact with the conductive pattern 4 and the common pattern 3 of the support member 2, and slides on the conductive pattern 4 and the common pattern 3 in response to the rotation of the rotating member 6. In addition, at the top surface of the rotating plate 6*a*, is built a click cam unit 6*c* that is composed of concavities and convexities continued in a circular shape.

In addition, the rotating axis 6*b* is hollow and a large engagement hole 6*d* is provided in the center of the rotating axis 6*b*. A plurality of click units 6*e* protruding outward are provided at the top surface of an external portion of the rotating axis 6*b*, and guide protrusion units 6*f* protruding outward are provided along the up and down directions of the lower surface from its center.

The engagement hole 6 of the rotating axis 6*b* is engaged with the cylindrical axis 1*b* of the housing 1 in the rotating member 6 so that the rotating plate 6*a* is rotatably received within the receiving unit 1*c*. In this case, the sliding member 7 fixed at the bottom surface of the rotating plate 6*a* is in contact with the conductive pattern 4 and the common pattern 3 of the support member 2 positioned within the receiving unit 1*c* so that it can slide. And a manipulating knob of an electronic apparatus or the like which is not shown is engaged with the guide protrusion unit 6*f* and the click unit 6*e* of the rotating axis 6*b* so that the rotating member 6 is rotatably manipulated in response to the rotation manipulation of the manipulating knob.

The cover member 8*s* is formed such that a thin metal plate is punched and bent, and has a ring-shaped cover 8*a*, a plurality of locking pieces 8*b* extended downward from the cover 8*a*, a pair of snap pieces 8*c* opposing to each other, and a pair of guide pieces 8*d* opposing to each other in a different direction from the opposing direction of the snap pieces. In addition, a protruded fixing unit 8*e* which fixes a click plate 9 described later is provided on the cover 8*a*.

The cover member 8 is mounted in the housing 1 such that a plurality of locking pieces 8*b* are engaged with the plurality of concave grooves 1*h* provided at the external portion of the housing 1 to allow their front ends to be cocked so that the opening of the receiving unit 1*c* is covered. In addition, the pair of the guide plates 8*d* is engaged with the concave engagement units 1*d* and 1*e* of the receiving unit 1*c* while the protrusion units 2*b* and 2*c* of the support member 2 are pressed so that the support member 2 is securely interposed and positioned therebetween. In addition, the pair of the snap pieces 8*c* extend downward to the bottom surface from the external surface of the housing 1 so that it is snapped with a mounting hole of a printed circuit board such as an electronic apparatus which is not shown. In this case, the legs 1*g* of the housing 1 can be securely fixed by means of screws or the like if necessary.

The click plate 9 is arc-shaped with an elastic thin metal plate, and an engagement hole 9*a* is provided at both ends of the click plate to engage the fixing unit 9*e* of the cover member 8, and a protrusion unit 9*b* which protrudes downward is provided at the center of the click plate. When the rotating member 6 is rotated, the protrusion unit 9*b* slides on and contacts with the click cam unit 6*c* having an uneven structure formed on the top surface of the rotating plate 6*a* of the rotating member 6 so that a click feedback is provided.

In this case, when the protrusion unit 9*b* is positioned at the concave portion of the click cam unit 6*c*, the rotating member 6 is kept at its current position in a stable state, and the sliding member 7 is in contact with the low resistor unit 4*c* of the conductive pattern 4 in this stable state. As such, when the sliding member 7 is in contact with the low resistor unit 4*c*, the stable state is kept by means of the click body which is composed of the click plate 9 and the click cam unit 6*c*, so that a significant output change does not occur in the click-pausing state, the stable state (at the position of the concave portion), which yields a stable output.

In addition, in the above-described embodiment, the support member 2 provided with the conductive pattern 4 is received and positioned within the receiving unit 1*c* of the housing 1, and the sliding member 7 which slides with the conductive pattern 4 is fixed to the rotating member 6, however, the present invention is not limited thereto, the sliding member 7 may be fixed to the receiving unit 1*c* of the housing 1, and the support member 2 provided with the conductive pattern 4 may also be fixed to the rotating member 6.

In addition, the support member 2 is composed of a resin-stacked plate such as phenol resin, however, it may be ring-shaped with an insulating material such as FPC or a synthetic resin, and the common pattern 3 and the conductive pattern 4 may be formed in this support member. In addition, the housing 1 and the support member 2 may be formed as one body to allow the housing with the function of the support member 2 to be provided with the conductive pattern. In addition, in the above-described embodiment, the housing 1 is described as one member which has the receiving unit 1*c*, however, the housing may be formed to have two members such as a plate-shaped member and a frame-shaped member, and in this case, a function of the support member 2 may be provided to the plate-shaped member, which can form the conductive pattern in the plate-shaped member.

According to the above-described embodiment, the rotating type variable resistor has the ring-shaped support member 2 having the conductive pattern 4 on one surface, and the sliding member 7 which can slide relative to the conductive pattern 4, and the conductive pattern 4 is composed of the high resistor unit 4*b* containing carbon and the low resistor unit 4*c* having a specific resistance lower than that of the high resistor unit 4*b*, and the high resistor unit 4*b* and the low resistor unit 4*c* are alternately and repeatedly formed along a direction where the conductive pattern 4 and the sliding member 7 slide, wherein each of the low resistor units 4*c* is disposed between the high resistor units 4*b* at predetermined intervals along the sliding direction of the conductive pattern 4, so that the total resistance of the conductive pattern 4 can be decreased.

Accordingly, by means of the ring-shaped (i.e. circular ring-shaped) support member 2 having a large opening 2*a* in its center in the above-described embodiment, the total resistor value of the conductive pattern (resistor) can be decreased by, for example, about 10 kΩ even when the width of the conductive pattern 4 (resistor) cannot be increased.

What is claimed is:

1. A rotating type variable resistor, comprising:

a housing;

a rotating member disposed to be rotatable in the housing;

a ring-shaped support member having a conductive pattern at one surface of the support member and disposed at one of the housing and the rotating member; and a sliding member fixed to the rotating member, and capable of sliding relative to the conductive pattern, wherein the conductive pattern is composed of high resistor units containing carbon and low resistor units having a specific resistance lower than that of the high resistor units, and the high resistor units and the low resistor units are alternately and repeatedly formed along a direction where the conductive pattern and the sliding member slide, and wherein the low resistor units are composed of a silver layer and a carbon layer covering the silver layer, and the carbon layer and the high resistor units are formed of the same material.

2. The rotating type variable resistor according to claim 1, wherein the high resistor units contain a binder resin in which carbon black and graphite are dispersed.

3. The rotating type variable resistor according to claim 1, further comprising:

a click body supporting the rotating member at a predetermined position, wherein the rotating member is supported by the click body when the sliding member is in contact with the low resistor units of the conductive pattern so that a positional relationship between the conductive pattern and the sliding member is kept in a stable state.

4. A rotating type variable resistor, comprising:

a housing:

a rotating member disposed to be rotatable in the housing;

a ring-shaped support member having a conductive pattern at one surface of the support member and disposed at one of the housing and the rotating member; and a sliding member fixed to the rotating member, and capable of sliding relative to the conductive pattern, wherein the conductive pattern is composed of high resistor units containing carbon and low resistor units having a specific resistance lower than that of the high resistor units, and the high resistor units and the low resistor units are alternately and repeatedly formed along a direction where the conductive pattern and the sliding member slide, and wherein the conductive pattern is arc-shaped such that an entire region of the low resistor units is larger than that of the high resistor units.

5. The rotating type variable resistor according to claim 4, wherein the high resistor units contain a binder resin in which carbon black and graphite are dispersed.

6. The rotating type variable resistor according to claim 4, further comprising:

a click body supporting the rotating member at a predetermined position, wherein the rotating member is supported by the click body when the sliding member is in contact with the low resistor units of the conductive pattern so that a positional relationship between the conductive pattern and the sliding member is kept in a stable state.

* * * * *